US006315607B1

(12) United States Patent
Hwang et al.

(10) Patent No.: US 6,315,607 B1
(45) Date of Patent: Nov. 13, 2001

(54) PANEL-MOUNT ATTACHMENT WITH GUIDING DEVICE

(75) Inventors: Jenq-Yih Hwang, Irvine; Andrew Cheng, Cerritos, both of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/597,847

(22) Filed: Jun. 20, 2000

Related U.S. Application Data

(63) Continuation-in-part of application No. 09/351,924, filed on Jul. 12, 1999, now Pat. No. 6,113,423.

(51) Int. Cl.[7] ..... H01R 13/73
(52) U.S. Cl. ..... 439/557; 439/378
(58) Field of Search ..... 439/557, 248, 439/247, 378; 248/27.3; 411/508

(56) References Cited

U.S. PATENT DOCUMENTS 4,988,308 * 1/1991 Toedtman ..... 439/557
5,017,151 * 5/1991 Peterson ..... 439/557
5,286,222 * 2/1994 Yagi et al. ..... 439/557
5,391,091 * 2/1995 Nations ..... 439/378
5,535,100 * 7/1996 Lubahn et al. ..... 439/378
6,113,423 * 1/1991 Hwang ..... 439/557

* cited by examiner

*Primary Examiner*—Gary F. Paumen
(74) *Attorney, Agent, or Firm*—Wei Te Chung

(57) ABSTRACT

An electrical system comprises a panel defining at least an opening and a retaining hole therein. A first connector is adapted to be attached to the panel. A panel-mount attachment is engageable with the retaining hole for attaching the electrical connector to the panel. The panel-mount attachment includes a base plate in which a housing of the connector is integrally formed therewith, and a supporting post extending from the base plate. At least a deflectable vane sector extends outward and downward from an top portion of the post toward the base plate and a gap defined between a free end of the vane sector and the base plate for receiving the panel therebetween. The attachment further includes a guiding device formed in the supporting post.

1 Claim, 4 Drawing Sheets

PANEL-MOUNT ATTACHMENT WITH GUIDING DEVICE

This is a continuation-in-part of U.S. patent application Ser. No. 09/351,924 and which was filed on Jul. 12, 1999, now U.S. Pat. No. 6,113,423 issued Sep. 5, 2000.

FIELD OF THE INVENTION

The present invention relates to a panel-mount attachment, and more particularly to a panel-mount attachment with a guiding device thereby facilitating correct and easy coupling with a complimentary connector.

DESCRIPTION OF THE PRIOR ART

Many prior art connectors have been provided with means for attaching the connector to a panel. Even the prior art panel mounted connector may readily be assembled to the panel, the backward movement of the connector during mating with a complimentary connector still need to be solved. In general, the panel mounted connector is assembled to the panel from a rear face. One of the typical example is the computer enclosure in which connectors are attached to the panel from inner side of the enclosure.

U.S. Pat. No. 4,988,308 discloses a panel mount having spiral vanes extending helically along the length of a support post. However, free ends of the spiral vanes are vulnerable to deflect or be damaged when excess mating force is exerted thereto.

On the other hand, there is a need to provide a guiding device between two mated connectors to ensure correct and smooth connection therebetween. In the existing structure, the support and vanes thereof are arranged in one side, while the guiding device is arranged at the other side. As a result, the connector should be assembled from outside instead of inside of the computer enclosure. Furthermore, when the connector is assembled to the panel from outside, the overall height or length of the connector exposed outside of the panel is inevitably increased. This is not acceptable. Furthermore, when attaching the cable assembly to the panel, the cable shall be directed through the opening firstly before the cable assembly is assembled to the panel, this is really laborious.

SUMMARY OF THE INVENTION

It is an objective of this present invention to provide a panel-mount attachment with a guiding device thereby facilitating correct and easy coupling with a complimentary connector.

In order to achieve the objective set forth, an electrical system comprises a panel defining at least an opening and a retaining hole therein. A first connector is adapted to be attached to the panel. A panel-mount attachment is engageable with the retaining hole for attaching the electrical connector to the panel. The panel-mount attachment includes a base plate in which a housing of the connector is integrally formed therewith, and a supporting post extending from the base plate. At least a deflectable van sector extends outward and downward from an top portion of the post toward the base plate and a gap defined between a free end of the vane sector and the base plate for receiving the panel therebetween. The attachment further includes a guiding device formed in the supporting post.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
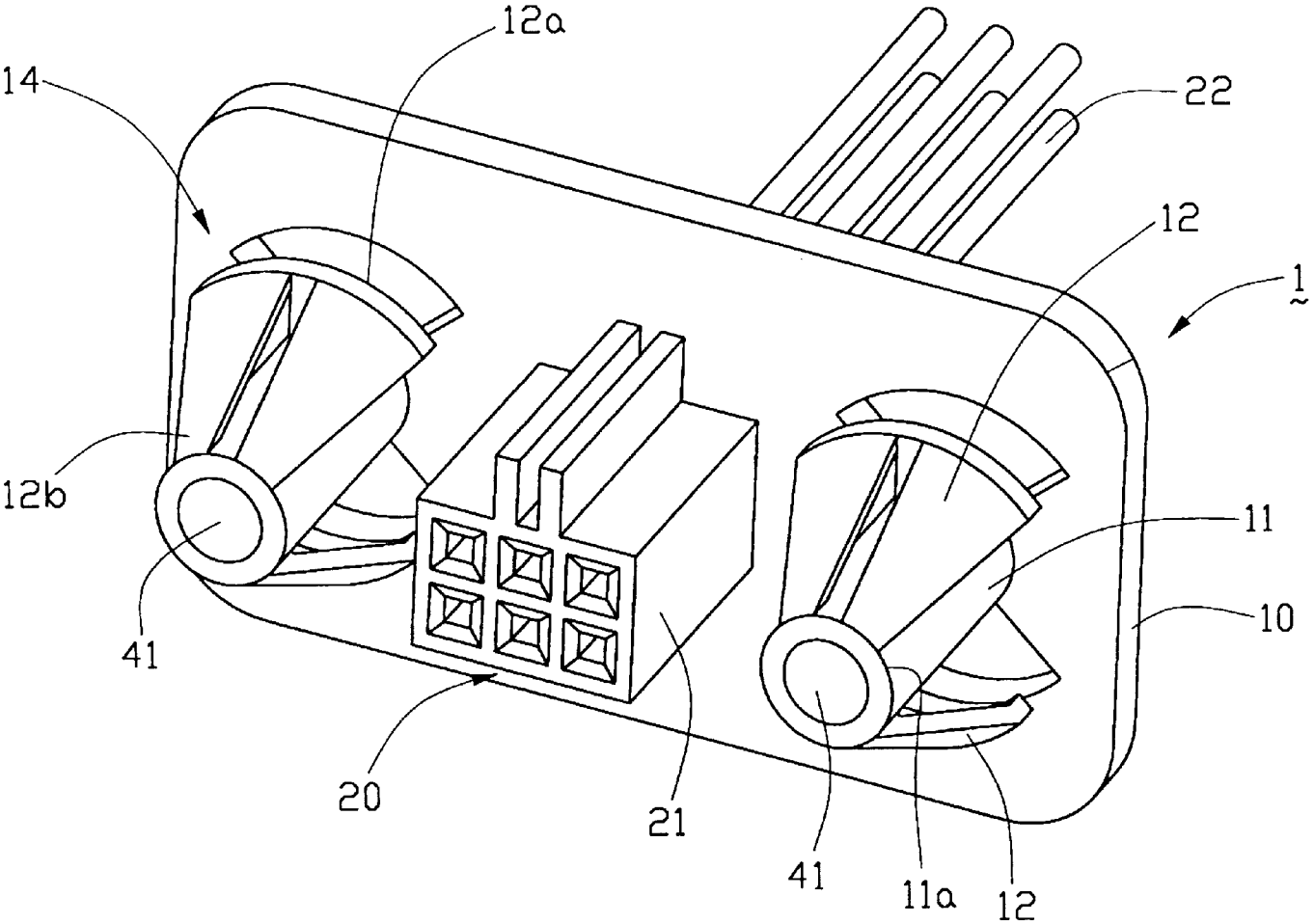
FIG. 1 is a perspective view of a connector incorporated with a panel-mount attachment in accordance with the present invention.

Referring to FIGS. 1 to 4, a panel-mount attachment 1 for attaching an electrical connector to a panel in accordance with the present invention includes a base plate 10 with a supporting post 11 extending from the base plate 10. Each supporting post 11 further includes two pair of deflectable vane sectors 12 extending outward and downward from an top portion 11*a* of the supporting post 11 toward the base plate 10. A gap 14 is defined between bases 12*a* of the vane sector 12 and the base plate 10. In the preferred embodiment, the width of the gap 14 is larger then the thickness of a panel 30.

According to one aspect of the present invention, a housing 21 of a connector 20 is integrally formed with the base plate 10. By this arrangement, the connector 20 together with its associated cable 22 can be readily assembled to the panel 30 of a device, for example a fan housing.

The panel 30 to be used with the connector 20 and the panel-mount attachment 10 includes an opening 31 for extension of the connector 20, and a pair of retaining holes 32 located adjacent to the opening 31. In order to ensure that the connector 20 is floatably attached to the panel 30, the dimension of the retaining holes 32 and the opening 31 is selected larger than the post 11 and the housing 21.

The deflectable van sections 12 form a semi-circular shape having an upper 12*b* smaller than the retaining hole 32 and a base 12*a* larger than the retaining hole 32. By this arrangement, the deflectable van section 12 can readily pass through the retaining hole 32 with the bases 12*a* shrink in, while the bases 12*a* pass over the retaining hole 32 and bounce back, the panel 30 is loosely sandwiched between the bases 12*a* and the base plate 10, thereby floatably attaching the connector 20 to the panel 30 of the computer enclosure.

By the provision of the instant invention, a guiding device 40 is integrally formed with the panel mount attachment 1. In the preferred embodiment of the instant invention, the guiding device 40 is a guiding passage 41 defined in the supporting post 11 and is adapted to receive a complimentary guiding pin 51 of a complimentary connector 50.

As described above, the guiding device 40 and the panel mount attachment 1 are integrally formed together and located at same side of the base plate 10, the connector 20 can be therefore attached to the panel 30 from inner side of the device. In addition, since the connector 20 is assembled to the panel 30 from inside of the device, the cable attached to the connector 20 can be easily arranged without raising any problem.

Figure 2:
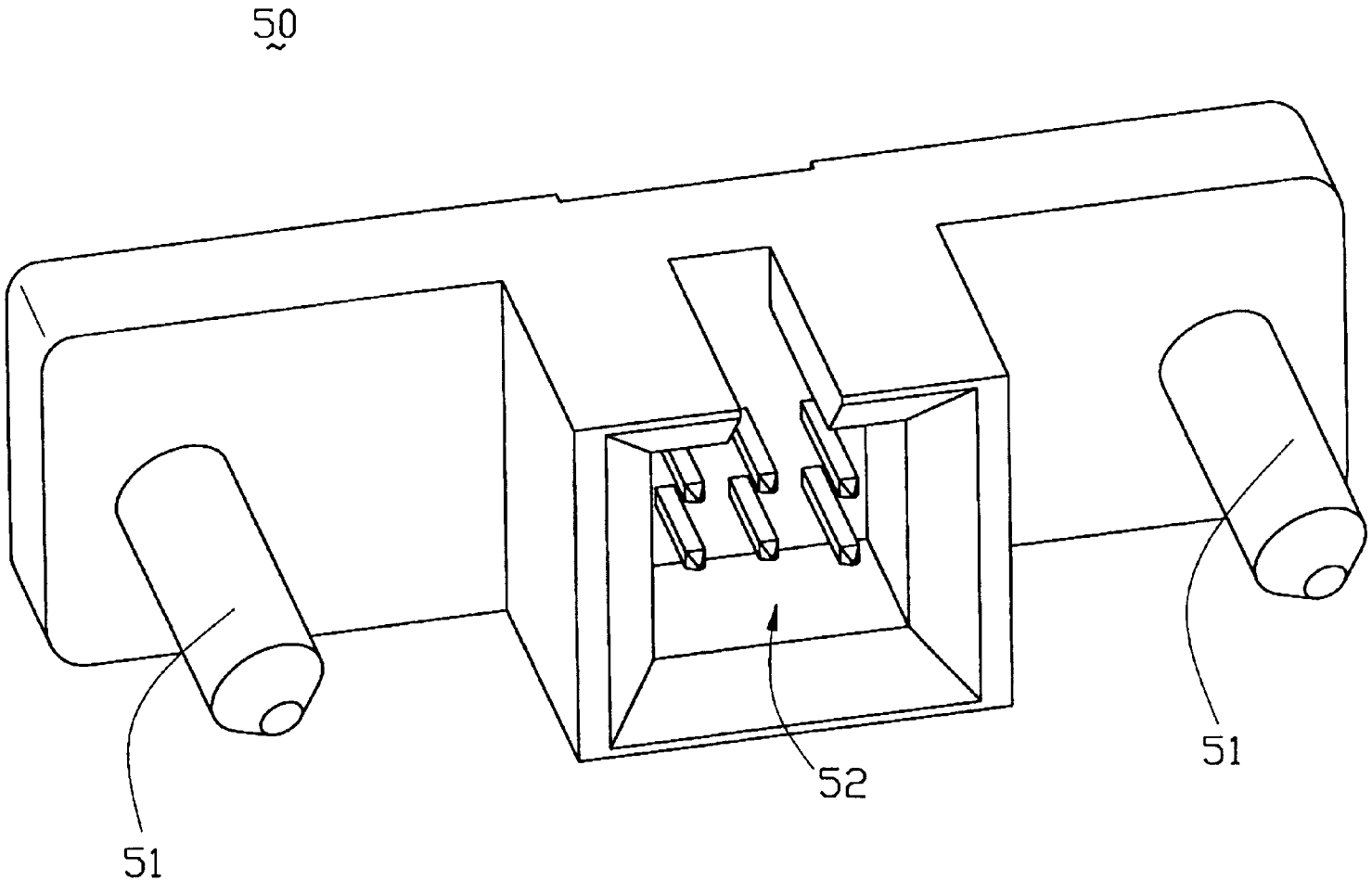
FIG. 2 is a perspective view of a complimentary connector mated with the connector of FIG. 1.
Figure 3:
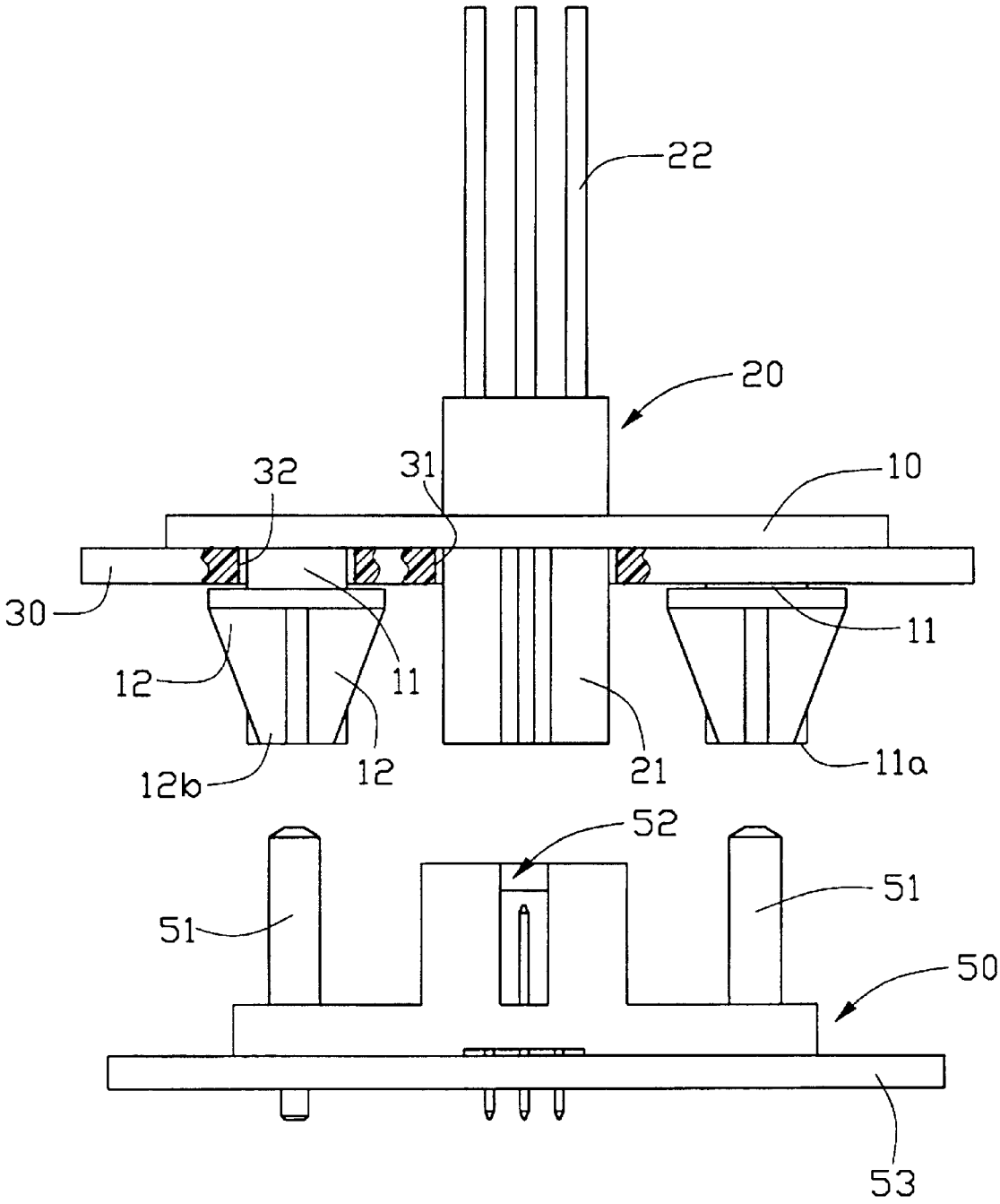
FIG. 3 is a top plan view of the connectors of FIGS. 1 and 2.
Figure 4:
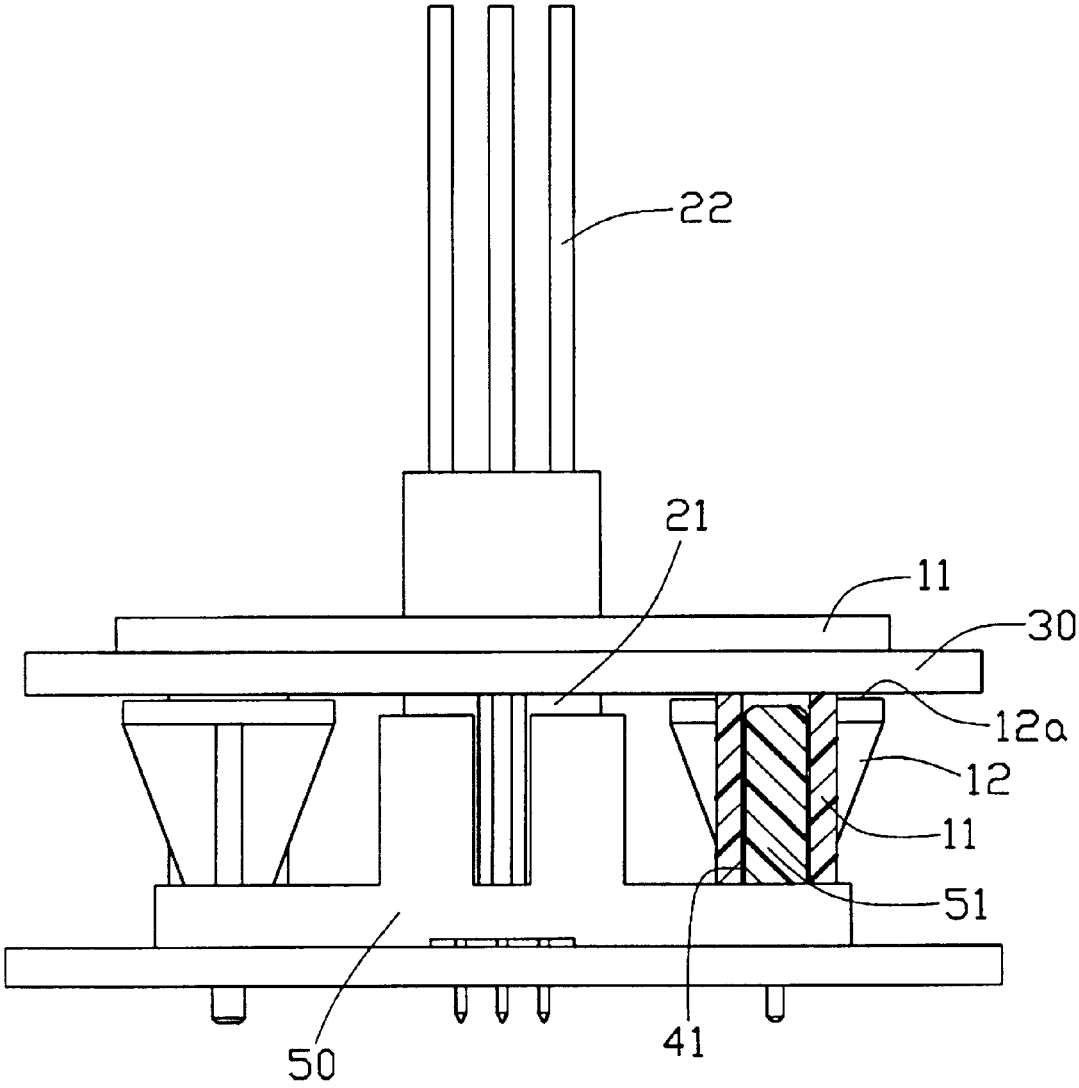
FIG. 4 is a top plan view of the connectors mated together.

As clearly shown in FIGS. 2, 3 and 4, the complimentary connector 50 defines a receiving space 52 for receiving the housing 21 of the connector 20. The connector 50 is fixedly attached to a substrate 53, which can be a printed circuit board for instance.

When the connector 20 is approaching to the connector 50, the guiding pins 51 will firstly meet with the passage 41 defined in the post 11 of the base plate 10. This will ensure a correct alignment between the housing 21 of the connector 20, and the receiving space 52 of the connector 50. Since the connector 20 is loosely fitted to the panel 30, any minor misalignment between the connectors 20, 50 can be easily compensated by the transverse movement of the connector 20 with respect to the panel 30, thereby ensuring correct electrical engagement between the connectors 20, 50.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector assembly, comprising:

a panel having front and rear faces and defining an opening and a retaining hole therein;

an electrical connector adapted to be attached to said panel;

at least a panel-mount attachment engageable with said retaining hole for attaching said electrical connector to said panel such that said connector extends through said opening and is accessible from front face of said panel, said panel-mount attachment including a base plate in which a housing of said connector is integrally formed therewith, and a supporting post extending from said base plate, at least a deflectable vane sector extending outward and downward from an top portion of said post toward said base plate, a gap defined between a free end of said vane sector and said base plate for receiving said panel therebetween, a first guiding device formed in said supporting post; and a second connector mateable with said first connector and including a second guiding device interconnected with said first guiding device thereby facilitating correct and easy connection between said first and second connectors;

wherein said first guiding device is a guiding passage defined in said supporting post;

wherein said second guiding device is a guiding post received in said receiving passage when said first and second connectors are mated.

* * * * *